US005186635A

United States Patent [19]

Pechulis et al.

[11] Patent Number: 5,186,635

[45] Date of Patent: Feb. 16, 1993

[54] ELECTRICAL CONNECTOR ASSEMBLY WITH EMI PROTECTION

[75] Inventors: Joseph W. Pechulis, Monroe; Joseph T. Cronan, Hamden, both of Conn.

[73] Assignee: United Technologies Corporation, Hartford, Conn.

[21] Appl. No.: 856,416

[22] Filed: Mar. 24, 1992

[51] Int. Cl.[5] ..... H01R 13/648

[52] U.S. Cl. ..... 439/89; 439/271

[58] Field of Search ..... 439/88-90, 439/271-277, 607, 609, 610

[56] References Cited

U.S. PATENT DOCUMENTS

| | | | |
|---|---|---|---|
| 3,835,443 | 9/1974 | Arnold et al. | 439/607 |
| 4,039,741 | 8/1977 | Havens | 174/35 |
| 4,296,390 | 10/1981 | Vanderheyden et al. | 333/182 |
| 4,349,241 | 9/1982 | Juris et al. | 339/143 |
| 4,497,531 | 2/1985 | Baker | 439/271 |
| 4,529,257 | 7/1985 | Goodman et al. | 439/271 |
| 4,563,052 | 1/1986 | Dietrich | 439/610 |
| 4,676,575 | 6/1987 | Denlinger et al. | 439/271 |
| 4,678,716 | 7/1987 | Tzeng | 428/551 |
| 4,925,404 | 5/1990 | Dutcher | 439/607 |
| 4,932,673 | 6/1990 | Domnikov et al. | 277/235 |
| 4,936,791 | 6/1990 | Zielinski et al. | 439/271 |

OTHER PUBLICATIONS

Cannon ITT, edition of The Cannon Standard Line Connectors catalog, 1978-1979, p. 117.

Chomerics, Inc., EMI Shielding Engineering Handbook, Theory of Shielding and Gasketing, 1989, pp. 2-7.

*Primary Examiner*—Neil Abrams

*Attorney, Agent, or Firm*—Patrick J. O'Shea

[57] ABSTRACT

An improved electrical connector assembly with EMI protection includes: (i) a conventional receptacle connector containing a plurality of electrically conductive pins surrounded by a receptacle flange, (ii) a conventional plug connector having a plurality of electrically conductive sockets surrounded by a plug flange, and (iii) an elastomeric belly band having conductive particles disposed throughout the band. The band is placed over the receptacle flange in tightly spaced relationship thereto, and the receptacle connector is mated with the plug connector to construct the assembly, such that the belly band covers both the plug and receptacle flanges to create a high conductivity path for impinging EMI. The EMI is attenuated within the band substantially reducing the detrimental effect of the EMI on the electrical signals conducted along the conductive pins/sockets. The band also creates an environmental seal which protects the electrically conductive sockets and pins for environmental contaminants such as moisture and corrosion.

8 Claims, 2 Drawing Sheets fig. 1
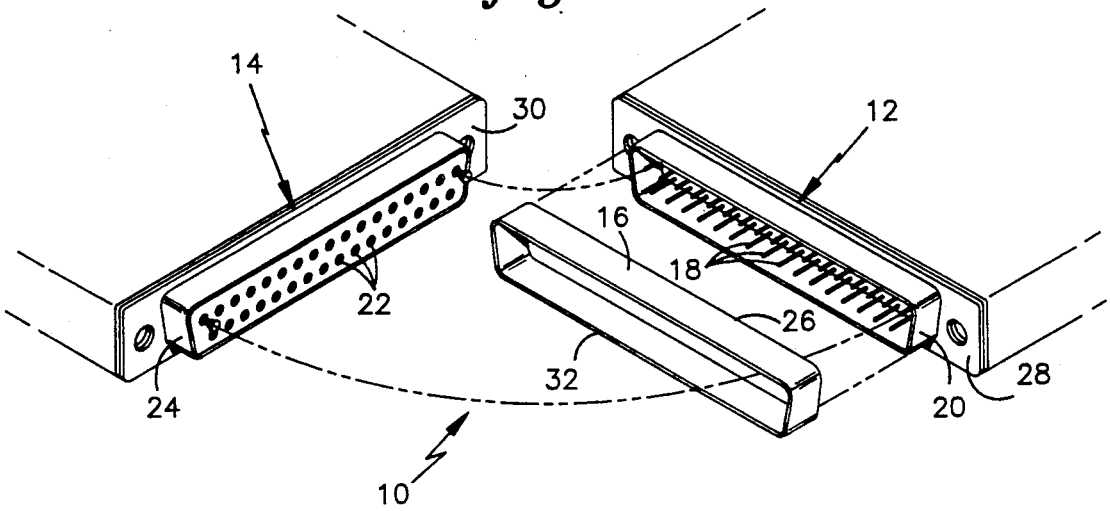
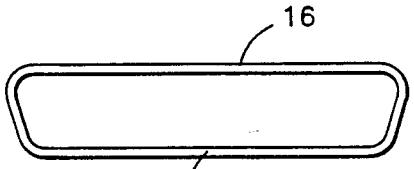
fig. 2
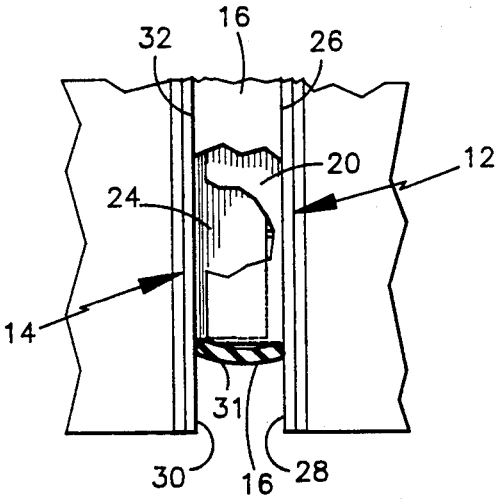
fig. 4
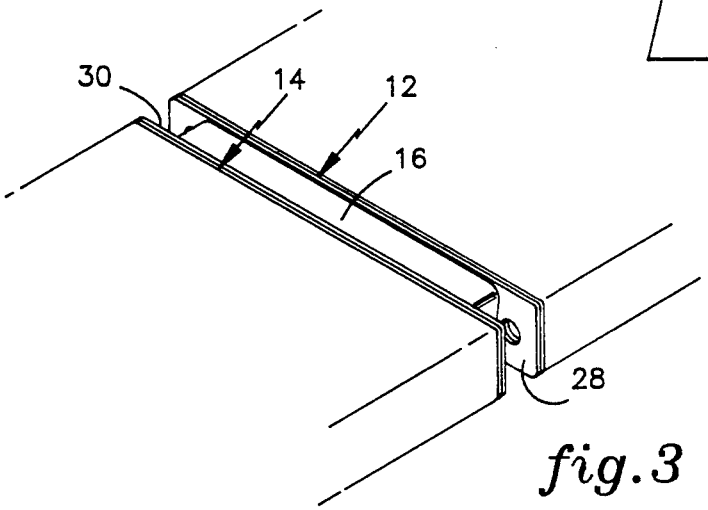
fig. 3

ELECTRICAL CONNECTOR ASSEMBLY WITH EMI PROTECTION

TECHNICAL FIELD

This invention relates to electrical connectors, and more particularly to electrical connectors which offer protection against electromagnetic interference and environmental contamination.

BACKGROUND ART

Electronic/electrical circuitry is often operationally degraded due to the coupling of electrical noise through connectors which carry electrical signals to and from the circuitry. This degradation is partially due to the connector's susceptibility to external electromagnetic interference (EMI). Similarly, the lack of protection from electromagnetic interference allows the electrical signals to radiate outward from the connector assembly and contaminate the surrounding environment with EMI generated by the circuitry. The electrical signals may also be degraded due to environmental contamination (e.g., salt spray, corrosion, etc.) of the conductive electrical elements within the connector.

Various types of connectors are available to reduce these detrimental affects depending on the severity of the environment and the product usage for the particular connector (e.g., avionics, computers, automotive, etc.). Connectors typically used in avionics systems are often designed to meet the requirements put forth in the Department of Defense standard, MIL-C-38999. Connectors designed to this military standard can offer built-in protection against both EMI and environmental contamination. However, due to the size and expense of these connectors, there are situations where either space or weight is severely limited and thus these heavy duty connectors are not suitable or cost effective.

A connector widely used in the computer industry is the well known generic multipin "D" type electrical connector, which in the military market is built per the requirements of MIL-C-24308. "D" type connectors are relatively compact in both size and weight. However, the conventional "D" type connector does not incorporate the level of EMI and environmental protection offered by the MIL-C-38999 connector. In avionics systems (e.g., fighter/attack aircraft radars within a radome) conventional "D" type connectors are often external to a housing, and hence very susceptible to EMI coupling.

One alternative for reducing the EMI noise coupling and the resultant degradation of the signals in the "D" type connector, is to place analog filters within the electrical circuit receiving the signals. However, this can be expensive, prohibitively complex, and add too much weight and volume, particularly if each signal line from the connector requires analog filtering to attenuate the effects of the EMI signal degradation on the circuitry. Furthermore, filtering may not be a suitable alternative if the dominant noise from the EMI is at a low frequency, or within the frequency bandwidth of the signal carried within the connector.

SUMMARY OF THE INVENTION

An object of the present invention is to provide a conventional "D" type connector assembly having the capability to attenuate external EMI impinging on the connector assembly, and thus reduce the magnitude of the EMI energy which couples to and degrades the electrical signals and circuitry within the assembly.

Another object of the present invention is to provide a conventional "D" type connector assembly having the capability to attenuate the magnitude of EMI radiating from the electrical connector assembly.

Yet another object of the present invention is to provide an elastomeric band which surrounds the flanges of a mated conventional "D" type connector assembly and covers the mating interface of the assembly to provide a high conductivity path for electrical energy, such that the magnitude of the outward radiation of the electrical signals carried within the connector assembly is significantly reduced, along with the magnitude EMI coupled to electrical signals and circuitry within the connector assembly due external impinging EMI.

A further object cf the present invention is to provide an elastomeric band which surrounds the flanges and mating interface of a conventional "D" type connector assembly to provide protection against environmental effects, such as moisture and corrosion, preventing degradation of the electrical signals.

According to the present invention, an improved electrical connector assembly with EMI protection includes: (i) a conventional receptacle connector having a plurality of electrically conductive sockets surrounded by a receptacle flange, (ii) a conventional plug connector having a plurality of electrically conductive pins surrounded by a plug flange, and (iii) an elastomeric belly band having conductive particles disposed throughout the band; the band is placed over the receptacle flange in tightly spaced relationship thereto, and the receptacle connector is mated with the plug connector such that the belly band completely covers both the plug and receptacle flanges and the mating interface between the two flanges, and substantially attenuates the magnitude of the impinging EMI noise energy, and helps retain the internal assembly electrical signal energy thereby reducing the detrimental effect of EMI on the electronic/electrical circuitry and diminishes radiation leakage to the outside environment.

An advantage of the present invention is, that by placing the band of elastomeric material having conductive particles disposed therein, in tightly spaced relationship about the flanges of an electrical connector (e.g., a "D" type electrical connector assembly) such that the band also covers the mating interface of the assembly's plug and receptacle connectors, the circuit/-signal degradation due to EMI and other environmental effects is significantly reduced. The conductive particles disposed within the band create the high conductivity path which attenuates the energy of impinging EMI and retains the internal electrical signal energy, thereby reducing the EMI susceptibility of the otherwise relatively unprotected interface.

These and other objects, features and advantages of the present invention will become more apparent in light of the following detailed description of a best mode embodiment thereof, as illustrated in the accompanying drawings.

BRIEF DESCRIPTION OF THE DRAWINGS

FIG. 1 is a breakaway illustration of an improved "D" type electrical connector assembly constructed in accordance with the present invention;

FIG. 2 is an illustration of a front view of the elastomeric belly band;

FIG. 3 is an illustration of the electrical connector assembly of FIG. 1 in the mated position;

FIG. 4 is a top view of FIG. 3 partly broken away and partly in section; and

DESCRIPTION OF THE INVENTION

Figure 5:
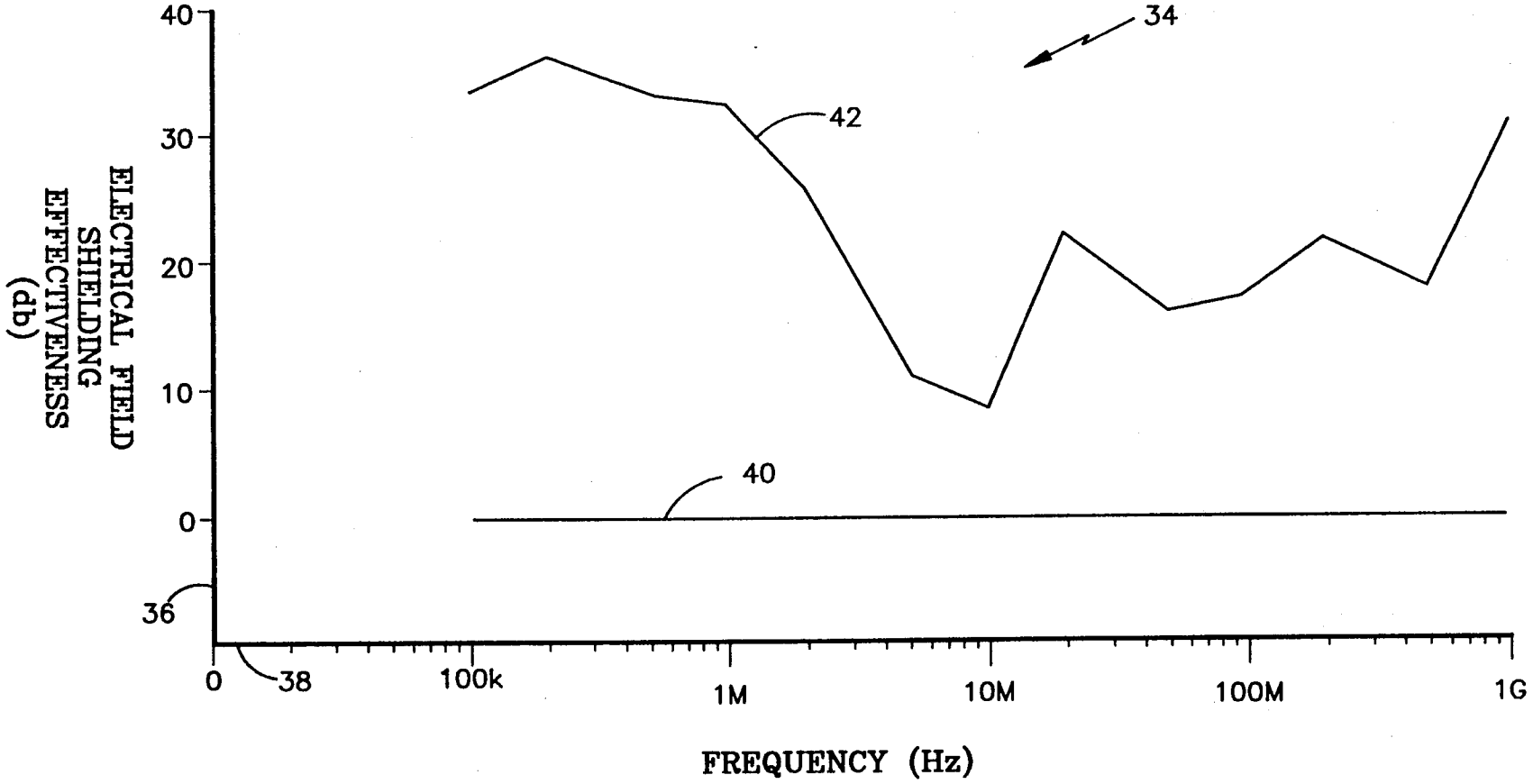
FIG. 5 is an experimentally derived plot illustrating the shielding effectiveness of the improved connector assembly of FIGS. 1 and 3, versus frequency.

Referring to FIG. 1 and 2, an improved multipin "D" type electrical connector assembly 10 includes a conventional receptacle connector 12, a conventional plug connector 14, and a belly band 16. The receptacle connector 12 incorporates a plurality of electrically conductive pins 18 surrounded by a receptacle flange 20. Similarly, the plug connector 14 includes a plurality of electrically conductive sockets 22 into which the plurality of pins 18 are inserted when the two connectors 12,14 are mated. The plurality of conductive sockets 22 are surrounded by a plug flange 24.

The belly band 16 slips in tightly spaced relationship over the receptacle flange 20, such that a first surface 26 of the belly band is flush against a face wall 28 of the receptacle connector 12. The plug and receptacle connectors are then engaged as illustrated in FIG. 3, slightly compressing the belly land 16 between the receptacle face wall 28 and a plug face wall 30 (FIGS. 1&3), such that the belly band is slightly bowed due to the compressive force of engaging the connectors 12,14.

The belly band provides protection against electrical signal degradation due to impinging EMI, reduces outward leakage of electrical signals and provides an environmental seal against moisture and other contaminants. The band may be a silicone elastomeric material such as a material meeting the standards of MIL-G-83528 type B or equivalent, with conductive particles (e.g., silver plated aluminum etc.) uniformly disposed therein to provide the required volume resistivity. The conductive particles create a high conductivity (i.e., low impedance) path which channels the EMI energy away from the plurality of conductive pins 18, and sockets 22 thereby reducing the amount of EMI coupled to the electrical signals conducted within the connector assembly 10. The frequency spectrum in which the belly band attenuates the EMI can be adjusted by varying the dispersion of the conductive particles and selection of the particle conductivity. The band also reduces the amount of EMI radiating from the connector assembly, and protects against moisture and other contaminants from entering the assembly.

FIG. 4 illustrates a top view of the mated assembly of FIG. 3, with the receptacle connector 12, and belly band 16 partially broken away and the belly band partially in section. Attention is drawn to the fact that a sectioned portion 31 of belly band 16 is shown slightly bowed due to the compressive force applied to the band by the face walls 28,30. Similar to the sectioned portion 31, the entire circumference of the belly band 16 is bowed due to the compressive force, thus ensuring the entire first surface 26 and the entire circumference of a second surface 32 (FIGS. 1,2 and 4) are in intimate contact with their corresponding face wall 28,30, respectively.

To further aid the belly band in making flush contact with the face walls 28,30, both the first surface 26 and the second surface 32 of the belly band 16 should be relatively smooth and free from irregularities and flash. The smoother the surfaces 26,32 compressed against the faces 28,30, the fewer the gaps there are between the face walls and the band surfaces, and hence the greater the EMI protection for the plurality of protective pins and sockets. However, even if irregularities do exist on the surfaces 26,32, by applying sufficient compressive force on the belly band between the face walls 28,30, it is ensured that the entire length of both surfaces 26,32 come in contact with their corresponding face walls 28,30 respectively.

Having observed the details of the present invention, an illustration of the invention's effectiveness is now in order. FIG. 5 illustrates a plot 34 of electric field shielding effectiveness (SE) in units of decibels (db) along a vertical axis 36, versus frequency on a logarithmic horizontal axis 38. The shielding effectiveness of the belly band 16 was tested in a frequency range from 100 KHz to 1 GHz. The procedure was to radiate EMI energy at the connector assembly under test, and measure the magnitude of the EMI coupled to the conductive pins 18 across the frequency range. The test was first performed with the connectors 12,14 mated without the belly band (i.e., a prior art configuration). The test was performed again with connectors 12,14 mated and the belly band in place as shown in FIG. 3 and in accordance with the present invention. The SE without the belly band is illustrated along a line 40, and the SE of the assembly with the belly band is illustrated along a line 42, both as a function of the spectral content of the radiated EMI. The plot along line 42 clearly illustrates the dramatic shielding provided by the band.

The present invention has been discussed with respect an advantage of significantly reducing the magnitude of EMI coupled to the electrical signals passing through the connector assembly. However, it should be understood the present invention also as the utility of reducing the amount of EMI radiated from the connector assembly. Furthermore, while the present invention has been discussed with respect to a conventional "D" type connector, the present invention is clearly not limited to this single type of connector. It is contemplated that the present invention may be utilized with many types of connectors where the advantages of the present invention such as ease of assembly are desired.

Another design feature of the present invention is that the belly band facilitates maintainability and repairability by permitting the mating connectors 12,14 and belly band 16 to be readily separated without the need for special tools. The existing belly band can be reused, or a substitute applied to the unmated connector assembly by slipping the band over the receptacle flange 20 and remating the connectors 12,14.

The present invention is also not limited by the shape of the belly band. The band shape is selected such that it easily slips over the receptacle flange and is in snugly spaced relationship thereto.

All these changes and variations are irrelevant to the invention, it suffices an electrical connector assembly with EMI protection includes: (i) a receptacle connector having a plurality of electrically conductive pins surrounded by a receptacle flange, (ii) a plug connector having a plurality of electrically conductive sockets surrounded by a plug flange, and (iii) an elastomeric belly band having conductive particles disposed throughout the band. The band is placed over the receptacle flange in snugly spaced relationship thereto, and the receptacle connector is mated with the plug connector such that the belly band completely covers both the plug and receptacle flanges and the mating interface between the two flanges. The band substantially attenuates the magnitude of the impinging EMI noise energy, thereby reducing the detrimental effect of the EMI on the signals conducted along the conductive pins/sockets, while reducing the magnitude of the radiated energy from the signals, and protecting the pins/-sockets from environmental.

Although the present invention has been shown and described with respect to a best mode embodiment thereof, it should be understood by those skilled in the art that various other changes, omissions and additions to the form and detail thereof, may be made therein without departing from the spirit and scope of the present invention.

We claim:

1. An electrical connector assembly with electromagnetic interference protection, comprising:

a conventional receptacle connector, having a plurality of electrically conductive pins surrounded by a receptacle flange;

a belly band of elastomeric material with conductive particles disposed through out which provides a high electrical conductivity path through said belly band, said band is positioned in tightly spaced relationship over said receptacle flange for attenuating impinging EMI; and a conventional plug connector, having a plurality of electrically conductive sockets for carrying electrical signals and a plug flange surrounding said plurality of conductive sockets, said plurality of conductive sockets are aligned with and mated with said plurality of electrically conductive pins such that said belly band covers said receptacle flange and plug flange and a mating interface there between, and said belly band bows when compressed between said flanges to ensure intimate electrical and physical contact between said belly band and said flanges.

2. The electrical connector assembly of claim 1 wherein the electrical connector is a conventional multipin "D" type electrical connector.

3. The electrical connector assembly of claim 2, wherein said conductive particles are uniformly disposed within said belly band.

4. The electrical connector assembly of claim 3, wherein said belly band further comprises a first surface the entire length of which comes into electrical and physical contact with a receptacle face wall of said receptacle connector, and a second surface the entire length of which comes into electrical and physical contact with a plug face wall of said plug connector.

5. The electrical connector assembly of claim 4, wherein said belly band also provides protection of said electrical pins and sockets from environmental contamination, and reduces the magnitude of electrical energy radiated from the assembly.

6. An improved multipin "D" type electrical connector assembly with electromagnetic interference protection, comprising:

a conventional receptacle connector, having a plurality of electrically conductive pins, surrounded by a receptacle flange perpendicular to and secured to a receptacle connector face wall;

a belly band of elastomeric material with conductive particles disposed through out which provides a high electrical conductivity path through said belly band, said band includes a first band surface and a second band surface, and said band is positioned in tightly spaced relationship over said receptacle flange for attenuating impinging EMI; and a conventional plug connector, having a plurality of electrically conductive sockets for carrying electrical signals and a plug flange surrounding said plurality of conductive sockets where said plug flange is perpendicular to and secured to a plug connector face wall, said plurality of conductive sockets are aligned and mated with said plurality of electrically conductive pins such that said belly band covers said receptacle and plug flanges and a mating interface there between, and the entire length of said first band surface comes into intimate electrical and physical contact with said receptacle face wall, and the entire length of said second band surface comes into intimate electrical ant physical contact with said plug face wall such that said belly band bows when compressed between said flanges further ensuring intimate electrical and physical contact between said belly band and said flanges.

7. The electrical connector assembly of claim 6, wherein said belly band also provides protection of said electrical pins and sockets from environmental contaminants, and attenuates the magnitude of EMI radiated from the assembly.

8. The electrical connector assembly of claim 7, wherein said conductive particles are uniformly disposed within said belly band.

* * * * *

UNITED STATES PATENT AND TRADEMARK OFFICE

CERTIFICATE OF CORRECTION

PATENT NO. : 5,186,635

DATED : Feb. 16, 1993

INVENTOR(S) : Joseph W. Pechulis, et al

It is certified that error appears in the above-identified patent and that said Letters Patent is hereby corrected as shown below:

Column 6, Claim 6, Line 36, "ant" should be --and--.

Signed and Sealed this

Eighteenth Day of January, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,186,635

DATED : February 16, 1993

INVENTOR(S) : Joseph W. Pechulis; Joseph T. Cronan

It is certified that error appears in the above-identified patent and that said Letters Patent is hereby corrected as shown below:

Column 1, line 3,

Please insert the following at the beginning of the specification, after the title --This invention was made with Government support under N00019-84-C-0098 awarded by the Department of the Navy. The Government has certain rights in this invention.--

Signed and Sealed this

Twenty-fourth Day of February, 1998

*Attest:*

Bruce Lehman

BRUCE LEHMAN

*Attesting Officer*

*Commissioner of Patents and Trademarks*